United States Patent [19]

Kresse et al.

[11] Patent Number: 4,961,242

[45] Date of Patent: Oct. 9, 1990

[54] WET MOP HEAD FOR FLOOR MOP

[75] Inventors: Franz Kresse, Hilden; Rainer Osberghaus, Duesseldorf; Bernfrid Scheller, Pulheim; Roland Schunter, Lorch-Waldhausen; Herta Tuchermann, Duesseldorf, all of Fed. Rep. of Germany

[73] Assignee: Henkel Kommanditgesellschaft auf Aktien, Duesseldorf-Holthausen, Fed. Rep. of Germany

[21] Appl. No.: 324,478

[22] Filed: Mar. 16, 1989

[30] Foreign Application Priority Data

Mar. 19, 1988 [DE] Fed. Rep. of Germany ..... 3809279

[51] Int. Cl.[5] ..... A47L 13/20

[52] U.S. Cl. ..... 15/228; 15/223; 15/224

[58] Field of Search ..... 15/114, 115, 118, 228, 15/223, 224, 244.1, 244.2

[56] References Cited

U.S. PATENT DOCUMENTS 2,702,914 3/1955 Kittle et al. ..... 15/114

FOREIGN PATENT DOCUMENTS 0101851 10/1985 European Pat. Off. .

632952 6/1963 France ..... 15/114

*Primary Examiner*—Edward L. Roberts

*Attorney, Agent, or Firm*—Ernest G. Szoke; Wayne C. Jaeschke

[57] ABSTRACT

An applicator or absorption cover for the head of a wet floor mop includes a textile support with holder insert-pockets sewn on the upper-side at opposite longitudinal ends, and with sponge-cloth or non-woven cloth material with high liquid take-up capacity being arranged as the underside material in the form of several strips in juxtaposed rows, with each of the strips attached over the area on the support, to take up dirt and liquids.

18 Claims, 1 Drawing Sheet

WET MOP HEAD FOR FLOOR MOP

BACKGROUND 1.0 Field of the Invention

The invention relates generally to floor mops, and more particularly to mop head coverings for floor mops for applying liquids to and taking up liquids from floors.

2.0 Discussion of Related Art

A wet mop covering for a floor map head is disclosed in DEGM [Utility Patent] 8220574. The covering consists of fringe-like material in loop form applied to the underside of a textile support structure. The fringe material may consist of fibers of animal or vegetable origin as well as synthetic material or mixtures of these materials. The fringes are intended to take up the soil or dirt, and the liquid cleaner applied to a floor. However, such wet mop head coverings have a relatively high inherent weight, and their liquid uptake capacity is limited.

When such wet mop head coverings are used in the cleaning of commercial buildings, for example, in order to achieve high performance, i.e., floor surface cleaned per unit time, it is desirable that the wet mop head coverings be both as light as possible, i.e., have a low inherent weight, and have a high dirt and liquid uptake capacity.

To provide wet mop head coverings with a high dirt and liquid uptake capacity, DE-GM 8434710 and DE-GM 8503569 teach the use of fleece strips arranged in wave form on the cleaning-active side of a mop head. The strips have longitudinal slits in the wave tips on the floor side, through which soil and liquid can penetrate especially well into the intermediate spaces, formed as hollow spaces open on the sides, between the support structure and wavy fleece strip. However, in practice, it has not been possible to achieve the cleaning effect desired by the users. The liquid uptake capacity of the material described in these references is inadequate. Also, the soil or dirty liquid uptake capacity, and the cleaning power of these prior coverings are not equal to those of known wet mop coverings with fringes, loops, tufts, or tassels, on the underside. In particular, the closed structure of the fleece strips, which are wavy in cross section, prevents the entire surface of such wet mop head coverings from being used for cleaning, since during the wiping motion, the surface located inside the cavities provided with the slits is not available for cleaning.

3.0 Summary of the Invention:

An object of the present invention is to provide an improved mop head covering for a wet mop, having the lowest possible inherent weight, high absorptive liquid uptake and liquid-retaining capacity with a simultaneously high dirt and dirty liquid uptake capacity.

In a wet mop head covering in one embodiment of the invention, sponge or fleece cloth material with a high liquid uptake capacity is applied in the form of several strips, arranged in lamellar fashion in rows one beside the other, for forming canals open on the floor side, wherein the strips are fastened in given areas to a support structure.

Such a wet mop head covering is very light and has a reduced weight in comparison to typical wet mop head coverings or applicators, and provides improved mopping effect and liquid uptake capacity. Because of the arrangement of the sponge cloth material strips, the wet mop covering glides very easily over the floor to be cleaned, and thereby readily takes up the liquid and the dirt. As a result of the strip-like arrangement of the material, the liquid and soil uptake are improved. Typically, wet mop head coverings are moved over the floor in so-called figure-eight motions, and in the one embodiment of the invention, the sponge cloth material strips flap over when the wet mop covering is moved back and forth over the floor.

Because of the low weight of the wet floor mop head covering, in accordance with the invention, a further advantage thereof is that cleaning and washing costs are lower compared with known conventional floor mop head coverings.

In another embodiment, the invention provides for rows of fringes, loops, tassels, or tufts arranged alternately beside the strips on the bottom. In this way, besides areas with high liquid uptake capacity (sponge or fleece cloth material strips), areas with especially high soil, dirt, or solid material uptake capacity are provided by fringes, loops or tufts.

In another embodiment the invention provides that surrounding fringes, loops or tassels are attached on the outer edge of the support. This outer surrounding fringe ring is arranged in the region of the greatest accumulation of dirt. The small fine hairs of the fringes hold the dirt particularly firmly and penetrate all joints and cracks without problem.

In yet another embodiment, the invention also provides that the sponge, non-woven, or fleece cloth material preferably consists of cotton and cellulose, or synthetic fibers, or a fiber mixture which has a thickness of 0.5 to 5 mm, a weight per unit area of 200 to 300 g/m$^3$, and a water uptake capacity of up to 3,600 g/m$^3$. In this manner, the water uptake capacity or the liquid storage capacity of the wet mop covering is further increased.

BRIEF DESCRIPTION OF THE DRAWINGS

An exemplified embodiment of the invention will be explained in greater detail below with reference to the accompanying drawing, in which like items are identified by the same reference number, wherein.

DETAILED DESCRIPTION OF THE INVENTION

Figure 1:
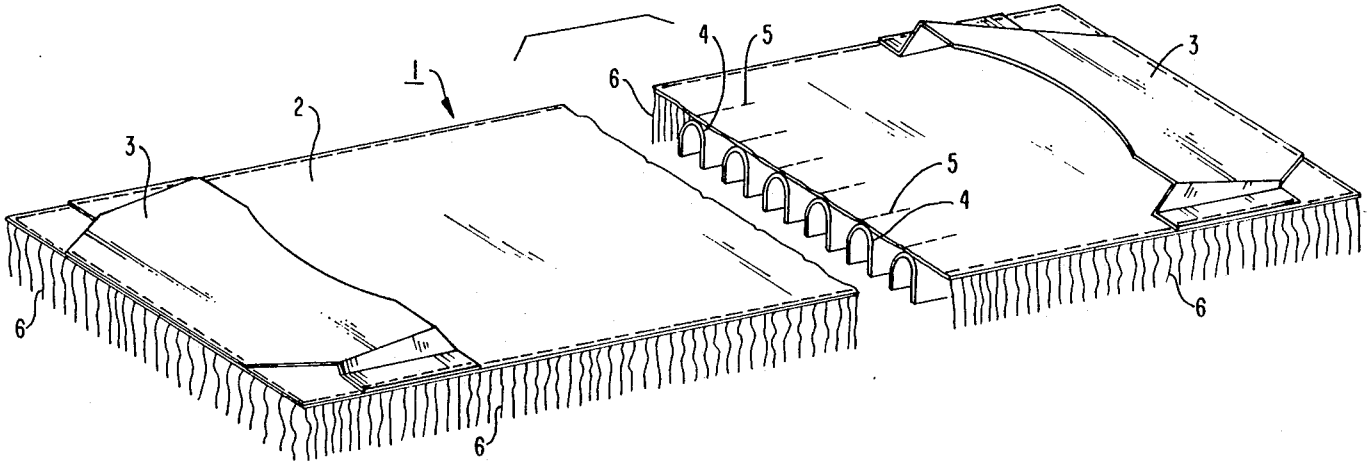
FIG. 1 is a partial cutaway pictorial view thereof.

The wet mop head or covering for a floor mop, designated as a whole by 1, in a preferred embodiment, has a textile supporting structure 2, on which two insert pockets 3 for insertably receiving therein a holder or mop head retainer (not shown) are sewn into each longitudinal end. The insert pockets 3 are preferably each formed as a unitary plastic piece, in this example, but can also be made of textile superficial structures. On its underside, i.e., on the cleaning-active side, the textile supporting structure 2 has strips 4 of sponge cloth material arranged in rows adjacent and parallel to one another. These strips 4 are arranged juxtaposed to one another in the longitudinal direction of the supporting structure 2, and in sectors along lines 5 (shown as broken lines, not of their full length) on the supporting structure 2. The strips 4 can be sewn, glued, or welded in place.

Circumferentially on the outer margin or edge of the textile supporting structure 2, fringes 6 are also fastened to its underside. These manifest a length that is customary in the case of wet mop coverings and are sewn, tufted, glued, or welded onto the supporting structure 2. This outer circumferential crown of fringe 6 is arranged in the area of the greatest dirt or soil contact. The fine hairs of the fringes 6 retain the soil, dirt, and other small particles, especially well. Also, hairs of fringes 6 readily penetrate into all joints and cracks. In addition to the outer edge covered with fringes 6, the textile support structure 2 is otherwise provided on its underside only with the strip-shaped sponge cloth material 4, in one embodiment.

The sponge cloth material of the strips 4, in one embodiment, consists of a mixture of cotton and cellulose. The strips have a thickness of 0.5 to 5 mm, a weight per unit area of 200–300 g/m$^3$ and a water uptake capacity of up to 3600 g/m$^3$ The sponge cloth material is boilfast, so that the entire wet mop cover can be laundered at temperatures of 60° C. The water uptake capacity of up to 3,600 g/m$^3$ was determined in accordance with DIN 53,923. Based on the weight per unit area, this water uptake means that the relative water uptake of the sponge material amounts to as such capacity as 1400%. This means that the sponge cloth material can take up about 1400% of its weight in liquid cleaner, water, or other liquids. Wet mop head coverings previously known from the state of the art do not have such high water uptake capacities. In addition, the sponge cloth material is characterized by a wetting time of less than 4 seconds, and a suction speed or drawing rate of more than 5 cm. The latter was measured on test pieces 15 mm wide in accordance with DIN 53,924, wherein the measurement time was 30 seconds and the test was performed without loading or weighting. In the moist state, the sponge cloth material has a tear strength of greater than 20 N.

The strips 4 can also consist of non-woven for fleece cloth material fabricated from synthetic fibers of a fiber mixture, wherein polyvinyl alcohol, polyester, or polyamide are examples of materials that are applicable for use, in other embodiments of the invention. A fleece cloth material of this type has the same properties as were previously described for the sponge cloth material. In another embodiment, in addition to the strips 4, the supporting structure 2 can also consist of the previously described sponge or fleece cloth material.

The fringes 6 fastened circumferentially on the outer edge of the textile support structure 2 may also be designed as loops, tufts, or tassels.

In an additional exemplified embodiment, not illustrated in FIG. 1, rows of fringes, loops, tufts, or tassels, are also alternatingly arranged on the underside of the supporting structure 2, in addition to the strips 4. These, like the strips 4, are arranged in the longitudinal direction of the supporting structure 2, parallel to the strips 4, and in each case are fastened along the lines 5 to the supporting structure 2. For these rows, the same fastening possibilities exist as for the fringes 6. All of the fringes, loops, tufts, or tassels described consist of a material customarily employed in wet mop head coverings.

The exemplified embodiments of the invention described may be modified in many ways without departing from the fundamental concept of the invention, or departing from the spirit and scope of the appended claims. For example, it is also possible that the rows of strips 4 and, if applicable, strips of fringes, loops, tufts, or tassels 6, are arranged not parallel to one another in the longitudinal direction of the supporting structure 2, but in the transverse direction with respect to the supporting structure 2. It is also conceivable for the material on the underside to be applied in circular form or zig-zag form or similar patterns.

What is claimed is:

1. An absorption head for a wet floor mop comprising a textile supporting structure having a top and an underside or bottom, and circumferential edges, with holder insert pockets sewn on the longitudinal ends of said top thereof, and with first and second material applied on said underside or bottom to take up soil and liquid, the first material including tassels of fine fibers thereof arranged circumferentially on the edges of said support structure, the second material having a high liquid uptake capacity, and being formed into several strips arranged in lamellar fashion juxtaposed to one another and forming U-shaped channels, wherein the strips are respectively fastened in sectors to the underside interior portions of said supporting structure, with said U-shaped channels opening away from the bottom of said structure.

2. The wet floor mop head of claim 1, wherein said second material consists of cotton and cellulose.

3. The wet floor mop head of claim 2, further including said second material having a thickness of 0.5 mm to 5 mm, a weight per unit area of 200 to 300 g/m$^3$, and a water uptake capacity of about 3,600 g/m$^3$.

4. The wet floor mop head of claim 1, wherein said supporting structure includes sponge-like material, made of cotton and cellulose.

5. The wet floor mop head of claim 1, wherein said second material consists of synthetic fibers.

6. A head for a wet floor mop comprising:

a support structure having a top and a bottom;

a pair of mop head holder insert pockets rigidly attached at opposite ends on the top of said support structure;

U-shaped strips of highly liquid absorbent material rigidly attached along their central longitudinal portions to the bottom of said support structure, said strips being arranged juxtaposed to one another between opposite ends of said support structure, with the channels formed by said U-shaped strips opening away from the bottom of said support structure; and particulate collection means rigidly attached about the outermost circumference of the bottom of said support structure, for taking up small particles from a floor or suspended in a cleaning fluid applied to the floor.

7. The mop head of claim 6, wherein said strips consist of a sponge-like material.

8. The mop head of claim 6, wherein said strips consist of non-woven cloth.

9. The mop head of claim 8, wherein said non-woven cloth consists of fibers of polyvinyl alcohol.

10. The mop head of claim 8, wherein said strips of nonwoven cloth consists of fibers of polyester.

11. The mop head of claim 8, wherein said strips of nonwoven cloth consist of polyamide.

12. The mop head of claim 8, wherein said strips of nonwoven cloth consist of a fiber mixture of cotton and cellulose.

13. The mop head of claim 8, wherein said strips consist of synthetic fibers.

14. The mop head of claim 6, wherein said strips of material are fabricated from materials providing a thickness of 0.5 mm to 5.0 mm, a weight per unit area of 200 to 300 g/m$^3$, and a water uptake capacity approaching 3,600 g/m$^3$.

15. The wet mop head of claim 6, wherein said insert pockets are fabricated from a plastic material.

16. The wet mop head of claim 6, wherein said support structure is rectangularly shaped.

17. The wet mop head of claim 6, wherein said support structure is fabricated from a textile material.

18. The wet mop head of claim 6, wherein said particulate collection means includes tassels of fine fibers of material.

* * * * *